United States Patent [19]

Stahlecker et al.

[11] 4,077,195

[45] Mar. 7, 1978

[54] OPEN-END SPINNING AGGREGATE

[76] Inventors: Fritz Stahlecker, Josef-Neidhart-Str. 18, 7341 Bad Überkingen; Hans Stahlecker, Haldenstrasse 20, 7334 Süssen, both of Germany

[21] Appl. No.: 722,033

[22] Filed: Sep. 10, 1976

[30] Foreign Application Priority Data

Apr. 9, 1976 Germany ..... 2615505

[51] Int. Cl.[2] ..... D01H 1/12

[52] U.S. Cl. ..... 57/58.89

[58] Field of Search ..... 57/58.89–58.95

[56] References Cited

U.S. PATENT DOCUMENTS

| | | | |
|---|---|---|---|
| 3,500,623 | 3/1970 | Oskin et al. | 57/58.89 |
| 3,511,042 | 5/1970 | Anna-Seidov et al. | 57/58.89 |
| 3,521,440 | 7/1970 | Oskin et al. | 57/58.89 |
| 3,557,542 | 1/1971 | Oskin et al. | 57/58.89 |
| 3,757,506 | 9/1973 | Kertschen et al. | 57/58.95 |
| 3,981,133 | 9/1976 | Neubert et al. | 57/58.95 |

*Primary Examiner*—Richard C. Queisser
*Assistant Examiner*—Charles Gorenstein
*Attorney, Agent, or Firm*—Craig & Antonelli

[57] ABSTRACT

An open-end spinning aggregate with a housing connected to a vacuum source, in which is arranged a spinning rotor provided with an open end-face, into which projects an insert leaving an annular gap and containing a central filament removal channel as well as a fiber feed channel whose orifice is disposed opposite a fiber-collecting surface of the spinning rotor which extends from the open end-face up to a fiber-collecting groove occupying the area of the largest diameter of the spinning rotor; ventilating bores are provided in the wall surface opposite the fiber-collecting surface with respect to the fiber-collecting groove whose axes extend at least approximately parallel to the axis of rotation of the spinning rotor.

13 Claims, 3 Drawing Figures

OPEN-END SPINNING AGGREGATE

The present invention relates to an open-end spinning aggregate with a housing connected to a vacuum source, in which a spinning rotor is arranged, into the open-end face of which projects an insert which covers the spinning rotor while leaving an annular gap and which contains a central filament removal channel and a fiber-feed channel whose discharge orifice is disposed opposite a fiber-collecting surface of the spinning rotor, which extends from the open-end face up to a fiber-collecting groove occupying the area of the largest diameter of the spinning rotor.

It is known from the British Pat. No. 1,154,840 to close off as tightly as possible the open-end spinning rotors accommodated in a housing of their own at the open-end face thereof by means of a cover-like structural part and to provide the same with ventilation bores. These ventilation bores have the task to produce a vacuum on the inside of the spinning rotor which is intended to effect the feed of loosened-up fiber material by means of an air stream. With this type of construction, the fibers are conveyed onto a fiber-collecting surface, from which they are displaced by reason of the centrifugal force exerted thereon onto a wall adjoining the fiber-collecting groove located within the area of the largest diameter of the spinning rotor. With this type of construction there exists, on the one hand, the disadvantage that the ventilation bores become clogged up by fibers taken along by the air flow so that after a certain operating period of time the functioning ability no longer exists. Additionally, it is unfavorable that with this type of construction an air flow has to be established inside of the spinning rotor from the fiber feed place to the ventilation bores, which crosses the fiber-collecting groove. As a result thereof, there exists the danger that the fed fibers are not conducted in an orderly manner onto the fiber-collecting surface but, under certain circumstances, are conducted already prematurely into the fiber-collecting groove. This may lead to an irregular fiber position and therewith to a poorer yarn quality. It is additionally unfavorable with this type of construction that the vacuum prevailing within the spinning rotors depends strongly upon the respective rotational speed of the spinning rotor, whence the operating conditions must be fixed within relatively narrow limits for each spinning rotor.

It is also known from the British Pat. No. 1,191,668 to provide a spinning rotor which is completely closed except for the open-end face thereof, and which, within the area of the open-end face, is covered off by an insert except for an annular gap. This spinning rotor rotates within a housing which is connected with a vacuum source that produces the vacuum necessary for the fiber transport. With this type of construction, the air necessary for the transport of the fibers flows off by way of the open-end face of the rotor through the annular gap. Since no ventilation bores are present, the danger of clogging is excluded. However, it has been shown in practice that this type of construction entails certain disadvantages since considerable quantities of fibers are torn along and sucked off by the outflowing air by way of the open edge of the spinning rotors. This leads to a clearly noticeable loss in fiber material and additionally to an increased soiling due to air-contamination of the entire open-end spinning machine which is equipped with a large number of such spinning aggregates. With this type of construction, careful attention must therefore be paid to the fact that a suitable vacuum is selected which, on the one hand, suffices for the fiber transport and, on the other, keeps within acceptable limits the fiber loss. This leads to considerable difficulties since it is not a simple matter from a technical point of view to realize in an open-end spinning machine which contains a large number of such spinning aggregates, an operation which maintains within narrow tolerances the required vacuum.

It is the aim of the present invention to so construct a spinning aggregate of the aforementioned type that, on the one hand, a loss of fiber material is avoided, whereas, on the other, the fiber feed is to be far-reachingly independent of the rotational speed of the spinning rotor. Additionally, it is also to be achieved by the present invention that vacuum producing means may be used which do not need to keep the operating conditions within narrow tolerances.

The present invention essentially consists in that ventilating bores are provided in the wall surface opposite the fiber-collecting surface with respect to the fiber-collecting groove, whose axes extend at least approximately parallel to the axis of rotation of the spinning rotor.

These ventilating bores are so constructed that they do not effect any significant air feed in the normal operation of the open-end spinning aggregate whereas they influence the flow conditions for the transporting air flowing into the spinning rotor. It is achieved thereby that the conveying or transporting air is not subjected to a premature deflection and is able to conduct the fibers practically up to the collecting surface. The loss of fiber material is far-reachingly avoided thereby since the fibers are securely seized by the collecting surface and are accelerated to the higher velocity so that they continue to be transported onto the fiber-collecting groove by reason of the centrifugal force acting thereon.

Accordingly, it is an object of the present invention to provide an open-end spinning aggregate which avoids by simple means the aforementioned shortcomings and drawbacks encountered in the prior art.

Another object of the present invention resides in an open-end spinning aggregate in which the operability of the aggregate is not impaired after a certain operating period of time by clogging of ventilating bores.

A further object of the present invention resides in an open-end spinning aggregate in which the fibers are fed onto the fiber-collecting surface in an orderly fashion, thereby assuring high quality yarns.

A still further object of the present invention resides in a spinning aggregate in which the operating conditions for each spinning rotor need not be kept within relatively narrow limits, particularly insofar as the vacuum is concerned.

Another object of the present invention resides in an open-end spinning aggregate which considerably reduces the soiling due to fibers torn along by the relatively high low velocities of the air.

A further object of the present invention resides in an open-end spinning aggregate in which, on the one hand, a loss of fiber material is avoided whereas, on the other, the fiber feed is far-reachingly independent of the rotational speed of the spinning rotor.

These and other objects, features and advantages of the present invention will become more apparent from the following description when taken in connection with the accompanying drawing which shows, for purposes of illustration only, one embodiment in accordance with the present invention and wherein.

Figure 1:
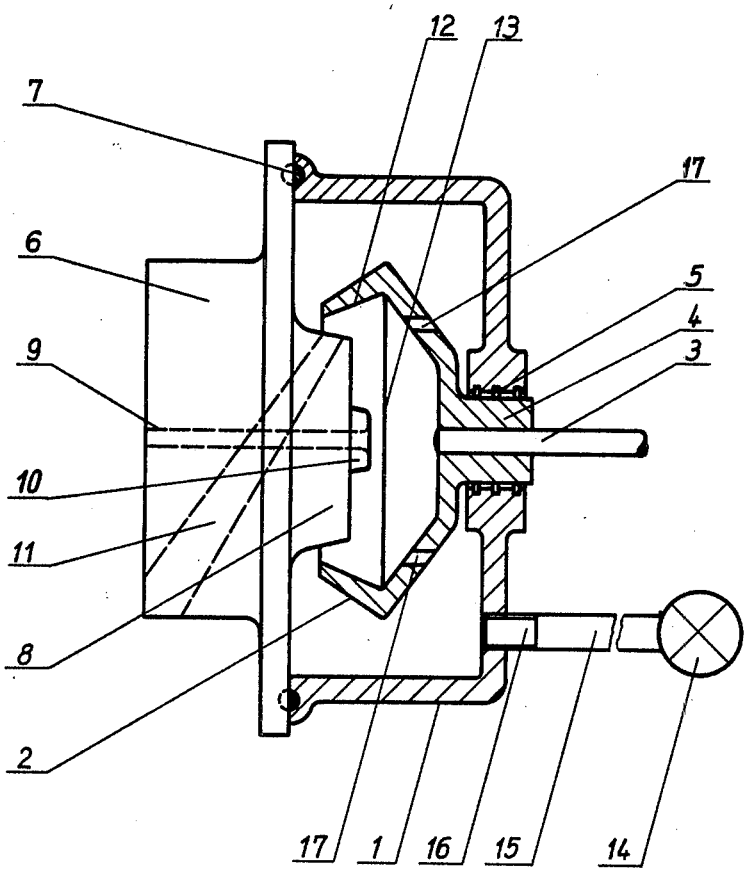
FIG. 1 is a somewhat schematic partial cross-sectional view through an open-end spinning aggregate in accordance with the present invention within the area of the spinning rotor and of a housing surrounding the same.

Referring now to the drawing wherein like reference numerals are used throughout the various views to designate like parts, in the open-end spinning aggregate illustrated in cross section in FIG. 1, a spinning rotor 2 is accommodated with a housing 1, whereby the spinning rotor 2 is extended by means of a shaft 3 out of the rear wall of the housing 1, is supported in any conventional manner, not illustrated, and is driven at high rotational speeds. The rotor 2 extends through the rear wall of the housing by means of an annular collar 4, within the area of which the housing 1 is provided with a labyrinth seal 5. The front end of the housing 1 is closed off by a cover-like structural part 6 whereby a sealing profile 7 is arranged between the housing 1 and the cover-like structural part 6.

The cover-like structural part 6 projects with a conical extension 8 into the open-end face of the spinning rotor 2. This extension 8 leaves an annular gap with respect to the open-end face of the spinning rotor 2. A filament removal channel 9 extends through the center of the cover-like structural part 6 and the extension 8, whose orifice disposed inside of the spinning rotor 2 is formed by a separate insert member 10. The cover-like structural part 6 additionally includes a fiber feed channel 11, by means of which loosened up fibers are fed to the spinning rotor 2. The discharge orifice of the fiber feed channel 11 is located opposite an inclined fiber-collecting surface 12 inclined with respect to the axis of rotation of the spinning rotor 2, which extends from the open-end face of the spinning rotor up to a fiber-collecting groove 13. The fibers fed to the fiber-collecting surface 12 slide along the inclined fiber-collecting surface 12 into the fiber-collecting groove 13 which is disposed within the area of the largest diameter of the spinning rotor 2.

In order to realize the fiber transport to the spinning rotor 2, a vacuum is produced in the spinning rotor 2 so that a transporting air stream which carries along the fibers, flows into the spinning rotor 2 through the fiber feed channel 11. The vacuum in the spinning rotor is produced with the aid of an external vacuum source 14 which is connected by way of a line 15 with a connection 16 of the housing 1. Whereas the fibers taken along by the transporting air stream are intended to impinge upon the fiber-collecting surface 12 and from there are intended to reach the collecting groove 13, the air stream itself has to be so deflected that it leaves the interior of the spinning rotor 2 by way of the annular gap between the open-end face and the extension 8.

In order to improve the air guidance of the transporting air stream and above all in order to improve the transport of the fibers, ventilating bores 17 are provided in the wall adjoining the fiber-collecting groove 13 on the side opposite the fiber-collecting surface 12, whose axes extend parallel or at least approximately parallel to the rotor shaft 3 and therewith to the axis of rotation of the spinning rotor. These ventilating bores 17 possess a relatively small diameter, of the order of magnitude of about 3 mm. Their number is so selected that together they have a cross section which amounts to about one-fourth to one-half the cross section of the annular gap between the open-end face of the spinning rotor 2 and the extension 8. The ventilating bores 17 are all disposed on a common diameter in relation to the rotor axis 3 whereby they are arranged uniformly distributed. Preferably six of these ventilating bores 17 are provided. Since the ventilating bores 17 have a constant cross section over the entire thickness of the wall and since their inner and outer orifices are located at the same distance to the rotor axis 3, they do not act in practice in the manner of radial blowers, i.e., they cause no air feed from the rotor interior toward the outside. As can be seen from FIG. 1, the openings are provided along an opening circle whose diameter corresponds approximately to the inner diameter of the open-end face of the spinning rotor 2.

If a pot-shaped symmetrical body, i.e., a pot-shaped body of rotation as is represented by the spinning rotor of FIG. 1, is set into rotation at high rotational speeds, then also the medium contained therein, i.e., in spinning rotors air, is set into rotation. These rotary movements subject the medium to a centrifugal force which leads to the fact that the medium will collect to an increased extent within the area of the largest diameter. With a gaseous medium, this results in a corresponding pressure distribution, i.e., within the area of the rotor axis, there results a vacuum and within the area of the largest diameter an excess pressure. The boundary between vacuum and excess pressure thereby extends approximately along the line 18 indicated in dash and dotted line in FIG. 2. This pressure distribution is only insignificantly influenced if an extension 8 is inserted into such a spinning rotor 2a corresponding to FIG. 2.

Figure 2:
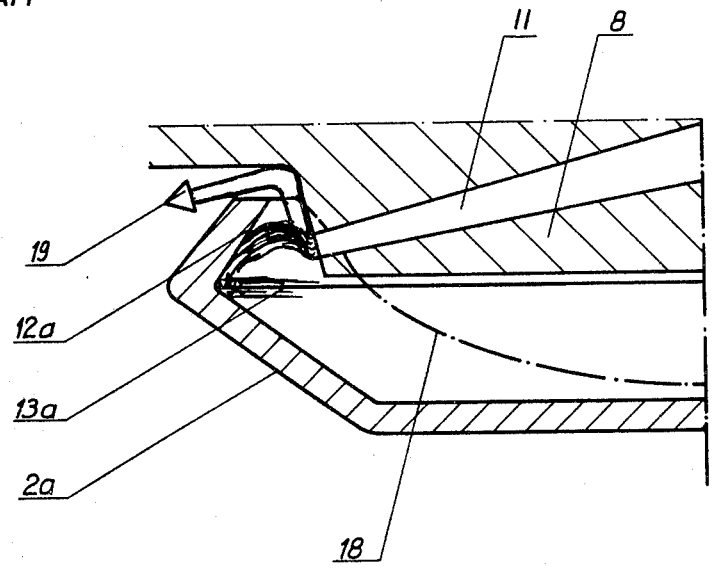
Fig. 2 Prior Art
FIG. 2 is a partial cross-sectional view, on an enlarged scale, of a part of a prior art open-end spinning aggregate.

The described pressure distribution will also in principle establish itself if a vacuum is produced by the vacuum source 14 in the housing 1 surrounding the spinning rotor 2*a*. Also when the pressure level is altogether decreased by this vacuum production, this does not change in principle anything in the pressure distribution illustrated in FIG. 2, i.e., within the area outside of the spinning rotor 2*a* there prevails a lower pressure than within the area of the fiber-collecting groove 13*a* and of the fiber-collecting surface 12*a* adjoining the same. This pressure distribution has as a consequence that the air stream leaving the fiber-feeding channel 11, which is indicated in FIG. 2 by the arrow 19, enters already immediately at its exit out of the fiber feed channel 11 into an area of increased pressure and therefore immediately is deflected toward the area of lower pressure, i.e., toward the annular gap between the extension 8 and the open-end face of the spinning rotor 2*a*. This means that the fibers transported by the air stream are subjected immediately after leaving the fiber feed channel 11 to an acceleration in the direction toward the open-end of the spinning rotor 2*a*, relatively long before they reach the area of the fiber-collecting surface 12*a*. As a result thereof, the danger becomes considerably greater that fibers are torn along by the air stream 19 and do not reach the fiber-collecting groove 13*a*.

Figure 3:
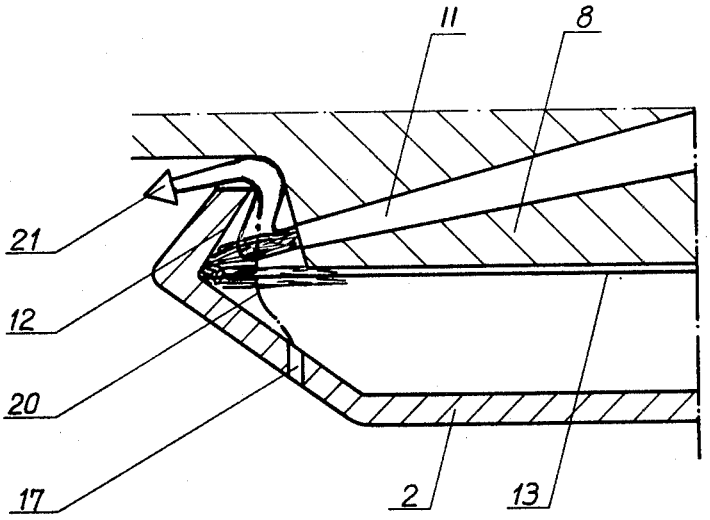
FIG. 3 is a partial cross-sectional view, similar to FIG. 2, illustrating on an enlarged scale the installation according to the present invention as shown in FIG. 1.

In order to eliminate the described disadvantage, ventilating bores 17 are provided in the wall of the spinning rotor opposite the fiber-collecting surface 12 which, by reason of their arrangement and construction, do not exert any pumping action or blower action, yet influence quite decisively the pressure distribution inside of the spinning rotor 2. Since a pressure equalization between the rotor interior and the rotor outside can take place within the area of the ventilating bores 17, at most only an excess pressure area or a zone of increased pressure may still form, which is located outside of the line 20 illustrated in dash and dotted lines in FIG. 3. It follows therefrom that the air stream 21 leaving the fiber feed channel 11 does not encounter immediately an air cushion which is under increased pressure but at first is able to continue to move in the direction which is imparted thereto by the fiber feed channel 11, namely in the direction toward the fiber-collecting surface 12. It reaches an air cushion with increased pressure only relatively close in front of the fiber-collecting surface 12 so that it will be deflected essentially only thereat toward the open-end face of the spinning rotor 2. This means that also the fibers are subjected only relatively late with a component in this direction so that they reach safely and securely the fiber-collecting surface 12. The danger that they then might still be torn along toward the outside by the air stream 21, no longer exists. Instead, the fibers then slide along the fiber-collecting surface 12 into the fiber-collecting groove 13 by reason of the centrifugal force acting thereon. Altogether, the fiber transport and above all the transfer between the fiber feed channel 11 and the fiber-collecting surface 12 and the fiber-collecting groove 13 is considerably improved thereby which is effective advantageously on the parallelization and stretching of the individual fibers. Also the quality of the produced yarn is favorably influenced therewith.

The pressure distribution inside of the area of the fiber-collecting surface 12 and of the fiber-collecting groove 13 of the spinning rotor 2 can be influenced by the position of the ventilating bores 17, i.e., by the radial distance of the ventilating bores 17 to the fiber-collecting groove 13. The area, within which an increased pressure is able to build-up, will be reduced, the closer the ventilating bores 17 will move toward the fiber-collecting groove 13. However, limitations are imposed on the radial spacing of the ventilating bores 17 to the fiber-collecting groove 13 in that with too small a spacing, the danger exists that fibers may become seated in the ventilating bores 17 which might negatively influence the spinning operation.

It has been found that a radial distance of at least 6 mm. should be maintained. It is thereby favorable if the ventilating bores 17 are arranged on a bore circle which corresponds approximately to the diameter of the open-end face of the spinning rotor. It is also advantageous if the wall in which the ventilating bores 17 are provided is inclined toward the radial plane placed through the fiber-collecting groove 13 because in that case the distance of the ventilating bores 17 to the fiber-collecting groove 13 is additionally slightly increased without increasing the zone in which an increased pressure can build up.

If the axes of the ventilating bores 17 were provided so inclined to the rotor axis that the orifices disposed on the rotor outside have a smaller distance to the rotor axis than the inwardly disposed orifices, then an air feed from the outside to the rotor inside would be realized by the ventilating bores 17. This would lead to an increase of the pressure within the area of the fiber-collecting groove 13 and to a reinforced air flow toward the open-end face of the spinning rotor. In order to preclude in practice this action with certainty without having to make excessively high demands of the manufacturing tolerances, provision may be made that the axes of the ventilating bores may receive, as planned, a slight angular deviation in the other direction so that also with greater tolerances no feed of air can take place toward the interior of the rotor. In this case, the ventilating bores 17 provide a small pumping action which is directed toward the outside. However, the air stream which is produced thereby and which is, as such, already small, cannot negatively influence the results which are sought by the present invention.

From the foregoing, it follows that a clogging of the ventilating bores with the rotor according to the present invention is rather unlikely and, even if it took place, would lead to less consequential disadvantages. This can be explained on the basis that no significant air quantities flow through the ventilating bores when fibers are fed during the operation of the spinning rotor. As a result thereof, the danger that the fibers may reach the area of the ventilating bores exists only to a very slight, negligible extent. Larger air quantities flow temporarily through these ventilating bores only, while the spinning rotor is accelerated from standstill. In this case, however, for the most part no or at most only a slight fiber feed takes place so that also under those circumstances the clogging, if any, of the ventilating bores is only very slight. Furthermore, even if fibers were to collect in the ventilating bores, this would not have an excessive influence on the operating conditions of the spinning rotor according to this invention insofar as the resulting clogging would not be so pronounced that the bores would be closed off in an air-tight manner. However, even if this ever should be the case against all expectations, then the open-end spinning aggregate of the present invention would operate no worse than an open-end spinning aggregate without any ventilating bores and would again offer the advantages of the present invention after the cleaning of the rotor, which is normally undertaken periodically.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An open-end spinning aggregate, which includes a housing means adapted to be connected with a vacuum source, a spinning rotor means arranged within said housing means and having an open-end face, insert means projecting into said open-end face and covering the spinning rotor means while leaving an annular gap, said insert means being provided with a central yarn-removal channel and with a fiber feed channel having a discharge orifice disposed opposite a fiber-collecting surface in the spinning rotor means which extends from the open-end face up to a fiber-collecting groove occupying the area of largest diameter of the spinning rotor means, characterized in that ventilating bore means are provided in the wall surface on the other side of the fiber-collecting groove from the fiber-collecting surface, whose axes extends at least approximately parallel to the axis of rotation of the spinning rotor means, characterized in that the total cross section of the ventilating bore means amounts to about one-fourth to about one-half the cross-sectional area of the annular gap between the open-end face of the spinning rotor means and the insert means.

2. An open-end spinning aggregate according to claim 1, characterized in that the axes of the ventilating bore means are arranged on a circle substantially concentric to the axis of rotation of the spinning rotor means.

3. An open-end spinning aggregate according to claim 2, characterized in that the diameter of the circle corresponds approximately to the diameter of the open-end face of the spinning rotor means.

4. An open-end spinning aggregate according to claim 3, characterized in that at least six ventilating bore means are provided.

5. An open-end spinning aggregate according to claim 4, characterized in that the ventilating bore means are uniformly distributed along the circumference of the circle.

6. An open-end spinning aggregate according to claim 5, characterized in that the wall containing the ventilating bore means is inclined to a plane containing the fiber-collecting groove.

7. An open-end spinning aggregate according to claim 6, characterized in that the ventilating bore means are of substantially uniform cross section over their axial length.

8. An open-end spinning aggregate according to claim 7, characterized in that the ventilating bore means are positioned for producing at most a slight outwardly directed pumping action.

9. An open-end spinning aggregate according to claim 1, characterized in that at least six ventilating bore means are provided.

10. An open-end spinning aggregate according to claim 1, characterized in that the ventilating bore means are uniformly distributed along the circumference of a circle.

11. An open-end spinning aggregate according to claim 1, characterized in that the wall containing the ventilating bore means is inclined to a plane containing the fiber-collecting groove.

12. An open-end spinning aggregate according to claim 1, characterized in that the ventilating bore means are of substantially uniform cross section over their axial length.

13. An open-end spinning aggregate according to claim 1, characterized in that the ventilating bore means are positioned for producing at most a slight outwardly directed pumping action.

* * * * *